US007827734B2

(12) United States Patent
Cox et al.

(10) Patent No.: US 7,827,734 B2
(45) Date of Patent: Nov. 9, 2010

(54) WINDOW ASSEMBLY WITH SASH FRAME INTERLOCKING SYSTEM TO RESIST WIND LOAD AND IMPACT

(75) Inventors: Dennis D. Cox, Middletown, OH (US); Robert Kushner, Bradenton, FL (US)

(73) Assignee: Deceuninck North America, LLC, Monroe, OH (US)

( * ) Notice: Subject to any disclaimer, the term of this patent is extended or adjusted under 35 U.S.C. 154(b) by 541 days.

(21) Appl. No.: 11/592,624

(22) Filed: Nov. 4, 2006

(65) Prior Publication Data

US 2008/0104892 A1 May 8, 2008

(51) Int. Cl.
*E05B 65/08* (2006.01)

(52) U.S. Cl. ..... 49/63; 49/61; 49/125; 49/183; 49/449

(58) Field of Classification Search ..... 49/504, 49/61, 63, 67, 125, 161, 176, 181, 183, 184, 49/185, 449, 475.1
See application file for complete search history.

(56) References Cited

U.S. PATENT DOCUMENTS 1,873,399 A * 8/1932 Haskell ..... 160/95
1,895,312 A * 1/1933 Dietz ..... 292/300
1,987,757 A * 1/1935 Snyder ..... 160/91
2,202,685 A * 5/1940 Bayley ..... 52/204.51
2,477,942 A * 8/1949 Renton ..... 49/408
3,208,564 A * 9/1965 Sitterly ..... 49/459
3,731,430 A * 5/1973 Dallaire et al. ..... 49/419
4,021,980 A * 5/1977 Wilfong ..... 52/202
4,083,148 A * 4/1978 Saucier ..... 49/125
4,086,727 A * 5/1978 Kuyper et al. ..... 49/255
4,106,239 A * 8/1978 Bancroft et al. ..... 49/449
4,344,257 A * 8/1982 Anderson ..... 49/504
4,799,330 A * 1/1989 Hudson ..... 49/62
4,831,781 A * 5/1989 Morton ..... 49/504
5,014,466 A * 5/1991 Winner ..... 49/504
5,274,955 A * 1/1994 Dallaire et al. ..... 49/406
5,810,429 A * 9/1998 Jardin et al. ..... 296/214
6,014,840 A * 1/2000 Ray et al. ..... 49/413
6,131,354 A * 10/2000 Thompson ..... 52/511
6,826,871 B2 12/2004 Morton et al.
6,871,885 B2 3/2005 Goldenberg et al.
6,925,758 B2 * 8/2005 Pettit ..... 49/460
7,104,015 B2 * 9/2006 Huynh ..... 52/208
7,490,873 B1 * 2/2009 Ricke et al. ..... 292/5

(Continued)

*Primary Examiner*—Gregory J. Strimbu
(74) *Attorney, Agent, or Firm*—Jacox, Meckstroth & Jenkins

(57) ABSTRACT

A window assembly includes a main outer support frame supporting at least one movable rectangular sash frame enclosing an insulated glass panel. The sash frame is supported for vertical or horizontal movement between open and closed positions, and an interlocking system is effective to lock adjacent overlapping sash frame members. The interlocking system includes an angular metal clip member mounted on one sash frame member and having a flange projecting into a slot within the adjacent sash frame member. A pair of clip members are located under the tilt latches on single and double hung window assemblies and are secured to a vertical sash frame member on a horizontal sliding window assembly. The interlocking system responds to a substantial positive or negative wind load or such a wind load after an impact which breaks a glass panel, to limit deflection and prevent permanent deformation or release of the movable sash frame.

15 Claims, 3 Drawing Sheets

U.S. PATENT DOCUMENTS

2003/0056442 A1* 3/2003 Gerard ..... 49/504
2004/0140061 A1* 7/2004 Woodward et al. ..... 160/92
2007/0157521 A1* 7/2007 Ito et al. ..... 49/185
2007/0289220 A1* 12/2007 Vilhauer ..... 49/449

* cited by examiner

WINDOW ASSEMBLY WITH SASH FRAME INTERLOCKING SYSTEM TO RESIST WIND LOAD AND IMPACT

BACKGROUND OF THE INVENTION

In the art of window assemblies having outer main window frames surrounding sash frames and formed of extrusions of a rigid plastics material or polyvinylchloride, commonly referred to as vinyl or PVC, it has been found desirable in some installations, especially in residential and commercial buildings near the ocean and Gulf coast, to provide for keeping the window assembly in tact during a high wind load, for example, during a hurricane or tornado. For example, U.S. Pat. No. 6,826,871, which issued to the assignee of the present invention, discloses a double hung or single hung window unit constructed of vinyl extrusions and incorporating hook members on the sill and bottom sash frame member. The hook members engage in response to a high negative wind load to limit deflection of the sash frame and thereby avoid permanent deformation and/or separation of the sash frame from the main frame. It is also desirable to limit deflection of the sash frames or separation of the sash frame from the surrounding main frame when the sash frames and glass panel units are subjected to either a high negative or a high positive wind load and such a wind load after an impact by an object sufficient to break one or both of the glass panel units, such as, during a hurricane or tornado.

SUMMARY OF THE INVENTION

The present invention is directed to an improved window assembly which may be in the form of a single hung or double hung window assembly or a horizontal sliding window or door assembly and including a main support frame surrounding at least one sash frame which is movable. All main frame and sash frame members are formed of extrusions of rigid plastics material or PVC, and each movable sash frame surrounds and supports a glass panel unit and is supported for either vertical or horizontal movement within the main support frame between open and closed positions. As used herein the term "sliding" also includes rolling as frequently used on sash frames of sliding glass windows and doors. The main frame includes upper and lower horizontal main frame members rigidly connected by vertical main frame members, and each movable sash frame includes upper and lower horizontal sash frame members rigidly connected by vertical sash frame members. When the main support frame encloses a fixed glass panel unit, the unit is supported by the main support frame and a meeting rail or fixed sash frame member located at the center of the window assembly.

A set of adjacent sash frame members are provided with an interlocking system which includes a rigid clip member. The clip member has a first flange secured to one of the adjacent sash frame members and a perpendicular second flange which projects into a deep groove or slot defined between parallel spaced walls of the adjacent overlapping sash frame member. In single and double hung window assemblies, the first flange is adapted to extend between a tilt latch and the upper sash frame member which receives the tilt latch. The second flange firmly engages one of the parallel spaced walls in response to a substantial positive or negative wind load force or such force after an impact which breaks the glass panel unit within a movable sash frame for limiting deflection and preventing permanent deformation or release of the sash frame or frames from the main support frame.

Other features and advantages of the invention will be apparent from the following description, the accompanying drawings and the appended claims.

DESCRIPTION OF ILLUSTRATED EMBODIMENTS OF THE INVENTION

Figure 1:
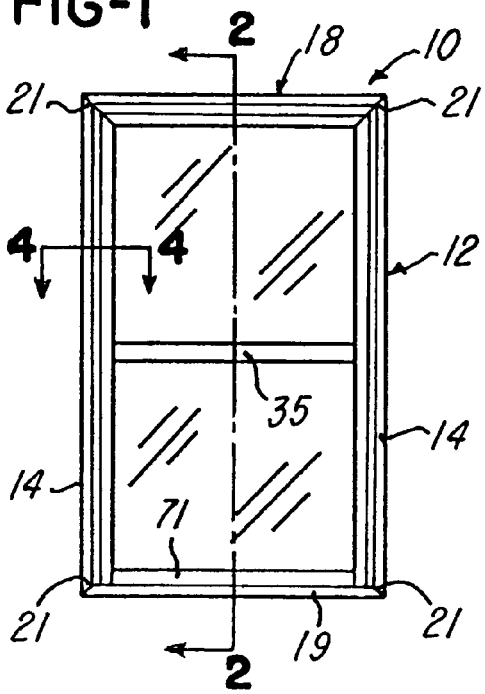
FIG. 1 is an outside elevational view of a closed single hung window assembly incorporating an interlocking system constructed in accordance with the invention.
Figure 2:
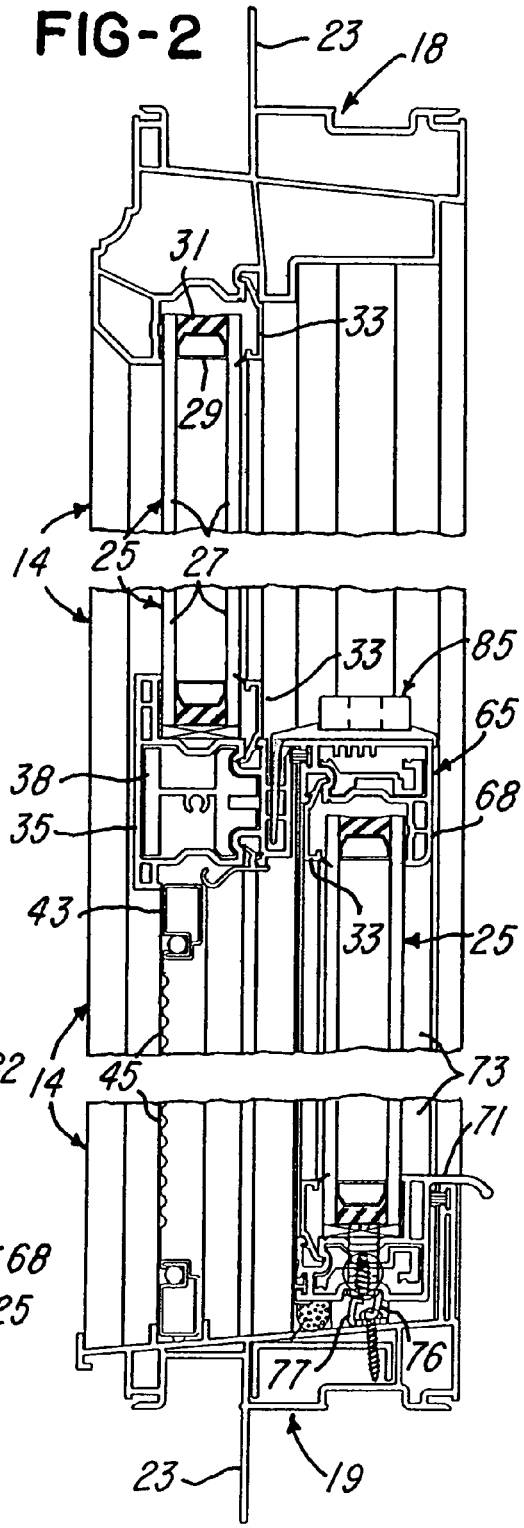
FIG. 2 is a vertical section of the window assembly of FIG. 1 taken generally on the line 2-2 of FIG. 1 and with portions broken away.
Figure 3:
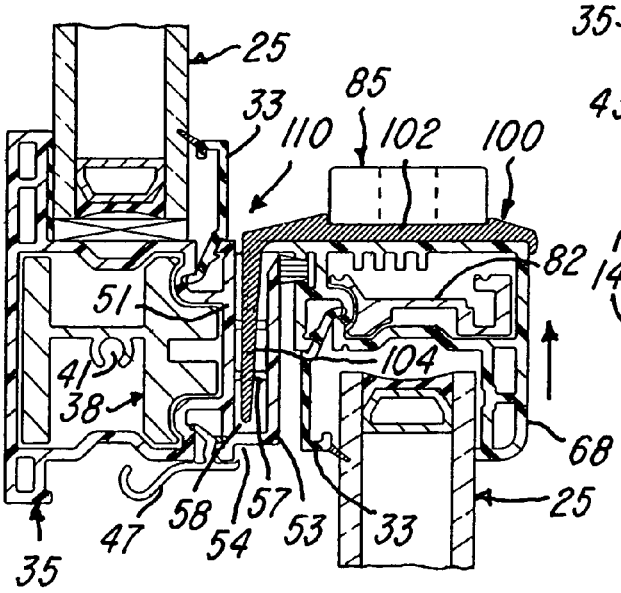
FIG. 3 is an enlarged fragmentary vertical section of the center portion of the window assembly shown in FIG. 2.
Figure 4:
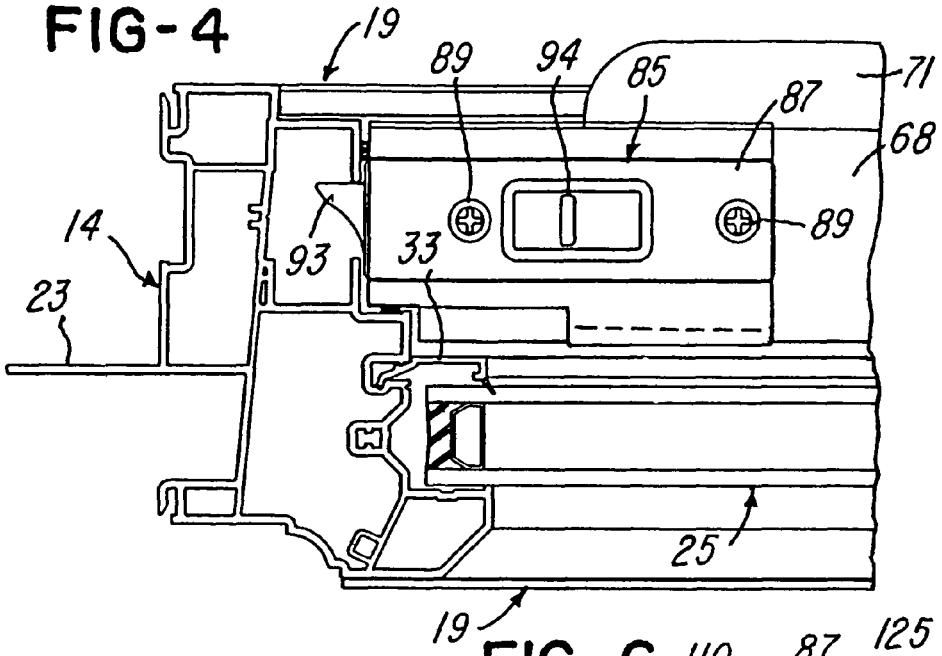
FIG. 4 is a fragmentary horizontal section taken generally on the line 4-4 of FIG. 1.

FIGS. 1-4 illustrate a single hung window assembly 10 which includes a rectangular outer or main support frame 12 constructed of horizontally spaced vertical main frame members 14 connecting an upper horizontal main frame member 18 and a lower horizontal main frame or sill member 19. The cross hatching for a plastics material and for metal and glass is shown in FIG. 3, but has been omitted in FIGS. 2, 4 & 6-9 for purpose of clarity. The outer frame members are formed from extrusions of rigid plastics material or vinyl and have generally a common cross-sectional configuration or profile as shown in FIGS. 2-4. The profile is generally the same as the profile disclosed in FIGS. 1 & 2 of above-mentioned U.S. Pat. No. 6,826,871, the disclosure of which is herein incorporated by reference. Preferably, the outer main frame members 14, 18 and 19 have welded mitered corner joints 21 and laterally outwardly projecting nailing flanges 23 used to secure the outer support frame 12 within a rough opening of a building structure with peripherally spaced nails.

As shown in FIG. 2, an insulated glass panel unit 25 is constructed in a conventional manner with parallel spaced rectangular glass panes or panels 27 separated by a peripherally extending spacer member 29 and bonded together by a bonding material 31 such as butyl rubber. The upper edge portion of the glass panel unit 25 is retained within the upper main frame member 18 by a removable extruded vinyl glazing strip or bead 33, and side edge portions of the glass panel unit 25 are retained by the upper portions of the vertical main frame members 14 and with corresponding removable vinyl glazing strips or beads or strips 33 (FIG. 4). The bottom edge portion of the glass panel unit 25 is retained within a horizontal fixed meeting rail or sash frame member 35 and a removable vinyl glazing strip or bead 33.

As shown in FIG. 3, the horizontal fixed meeting rail or sash frame member 35 encloses a linear section of a reinforcing member 38 which is in the form of a metal or aluminum extrusion and extends between the outer side frame members 14 to which it is rigidly secured by screws (not shown) threaded into the holes 41. The lower portion of the sash frame member 35 has a recess which receives an upper portion of a rectangular frame 43 of a removable screen unit 45. The bottom portion and vertical side portions of the screen frame 43 are retained within a channel formed within the outer side frame members 14 and bottom sill or frame member 19. The screen frame 43 is retained within the channel by an extruded plastic spring strip 47 which snaps into a groove within the bottom portion of the fixed sash frame member 35. As also shown in FIG. 3, the fixed sash frame member 35 has an inner vertical wall 51 and a parallel spaced wall 53 which are integrally connected by a bottom wall 54, a top wall (now shown) and vertically spaced intermediate tie walls or webs 57. The walls 51, 53 and 54 define an open top groove or slot 58 in an area where the top walls and webs 57 are cut away.

The outer frame 12 also supports a vertically movable or slidable rectangular sash frame 65 which includes a horizontal upper sash frame member 68 and a lower sash frame member 71 which are rigidly connected by a pair of vertical sash frame members 73. Each of the vertical sash frame members 73 has a profile mating with the profiles of the horizontal upper sash frame member 68 and the lower sash frame member 71. Preferably, the sash frame members are connected with mitered welded corner joints in a conventional manner. The sash frame 65 also encloses a glass panel unit 25 which is constructed as described above and is retained by removable glazing beads 33 of extruded plastics or vinyl material. The lower sash frame member 71 and the bottom sill or main frame member 19 are provided with interlocking hook members 76 and 77, respectively, which function in the same manner as the corresponding hook members disclosed in above-mentioned U.S. Pat. No. 6,826,871.

Referring again to FIG. 3, the upper horizontal sash frame member 68 has a hollow upper portion which receives an elongated reinforcing member 82 in the form of an aluminum extrusion which extends the full length of the sash frame member 68. The upper sash frame member 68 also supports a conventional tilt latch 85 located adjacent each of the outer vertical main frame members 14, as shown in FIG. 4. Each of the tilt latches 85 includes a housing 87 attached to the sash frame member 68 by a pair of screws 89, and the housing encloses a spring bias sliding latch element 93 which is retractable by moving a finger gripping tab 94.

Figure 5:
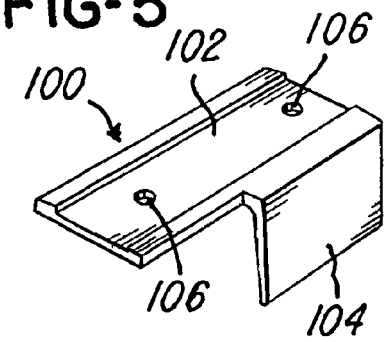
FIG. 5 is a perspective view of a clip member used in the interlocking constructed system in accordance with the invention.

In accordance with the present invention, an angular L-shaped clip member 100 (FIG. 5) is formed from a metal or aluminum extrusion and includes a first flange 102 and a second flange 104 which extends perpendicular to the first flange 102. Preferably, the first flange 102 has a length less than five inches or about three inches, and the second flange 104 has a length about half the length of the first flange 102 or about one and one half inches. As shown in FIGS. 3 & 4, the first flange 102 of the clip member 100 is located or positioned between the tilt latch 85 and the top surface of the upper sash frame member 68. The flange 102 has a pair of holes 106 (FIG. 5) which are aligned with the holes within the housing 87 of the tilt latch 85 for receiving the screws 89 which are threaded into the reinforcing member 82 enclosed within the sash frame member 68. When the sash frame 65 and the window panel 25 are in a closed position (FIG. 2), the second flange 104 projects downwardly into the slot 58 within the sash frame member 35 to form an interlocking system 110 which interlocks the overlapping sash frame members 35 and 68.

Thus when the glass units 25 and their supporting sash frame members are exposed to either a below atmospheric negative air pressure or an above atmospheric positive air pressure, for example, during a hurricane or tornado, the flange 104 will firmly engage one of the walls 51 or 53 and thereby lock the sash frame members together. While the interlocking system 110 is described in connection with the left side (FIG. 1) of the single hung window assembly 10 shown in FIG. 1, it is to be understood that the same interlocking system 110 is provided on the right side of the window assembly adjacent the right vertical outer sash frame member 14.

Figure 6:
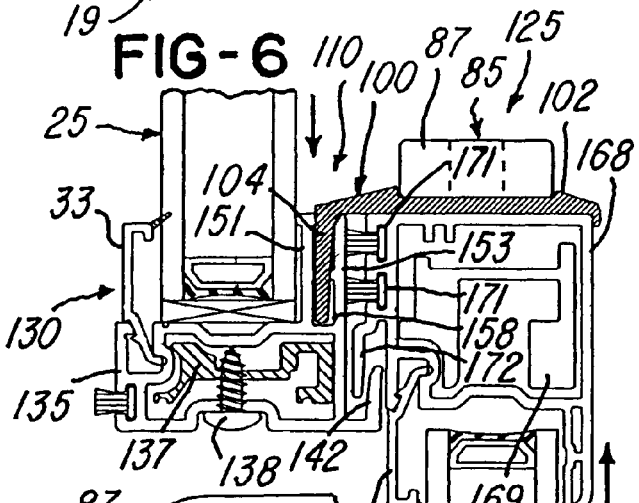
FIG. 6 is a fragmentary vertical section similar to FIG. 3 of a double hung window assembly incorporating the interlocking system in accordance with the invention.
Figure 7:
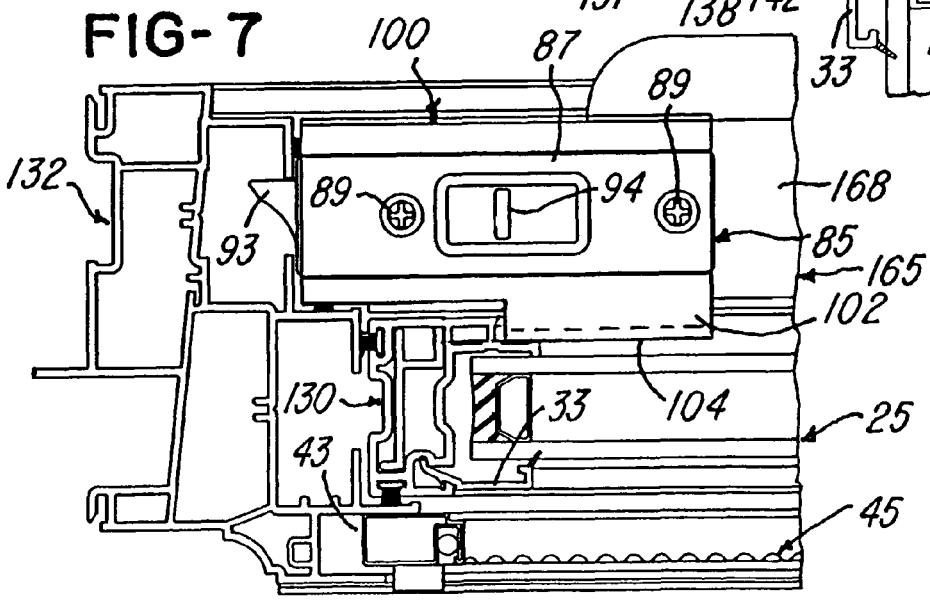
FIG. 7 is a fragmentary horizontal section similar to FIG. 4 of the double hung window assembly.

Referring to FIGS. 6 and 7, the interlocking system 110 may also be used on a double hung window assembly 125. In this assembly, an upper movable rectangular sash frame 130 is supported for vertical movement within an outer main frame 132 and includes a lower horizontal sash frame member 135 which receives the lower edge portion of an insulated glass panel unit 25 and is reinforced by an extruded aluminum reinforcing member 137 retained by a set of screws 138. The lower horizontal sash frame member 135 also has an upwardly projecting sealing lip 142 which is extruded as an integral part of the vinyl sash frame member, in a conventional manner. The sash frame member 135 is also extruded with an upwardly projecting wall 151 which engages the inner surface of the glass panel unit 25, and is also extruded with a parallel spaced inner wall 153. The parallel spaced walls 151 and 153 define therebetween an open top groove or slot 158 in the areas where the connecting top and intermediate walls have been cut away, in the same manner as described above in connection with the groove 58 within the sash frame member 35.

The double hung window assembly 125 also includes a lower sash frame 165 (FIG. 6) which has an upper horizontal sash frame member 168 reinforced by a metal or aluminum extrusion 169. The sash frame member 168 receives the upper edge portion of an insulated glass panel unit 25 retained on the sash frame member 168 by a glazing strip or bead 33. The sash frame member 168 supports a pair of elongated flexible weatherstrip seals 171 and has a downwardly projecting flange or lip 172 which interfits with the lip 142 to form a labyrinth-type seal, in a conventional manner.

As shown in FIG. 6, a clip member 100 is secured to the top surface of the sash frame member 168 under each of the tilt latches 85 and in the same manner as described above in connection with FIG. 3. The flange 104 of each clip member 100 projects downwardly into a corresponding slot 158 formed between the walls 151 and 153 of the lower sash frame member 135. The slot 158 is cut into the top wall and the connecting tie wall of the sash frame member 135 only for the length of the flange 104. Except for the grooves or slots, the parallel spaced walls 151 and 153 are integrally connected by the tie wall and the top wall which are interrupted by the slots.

Figure 8:
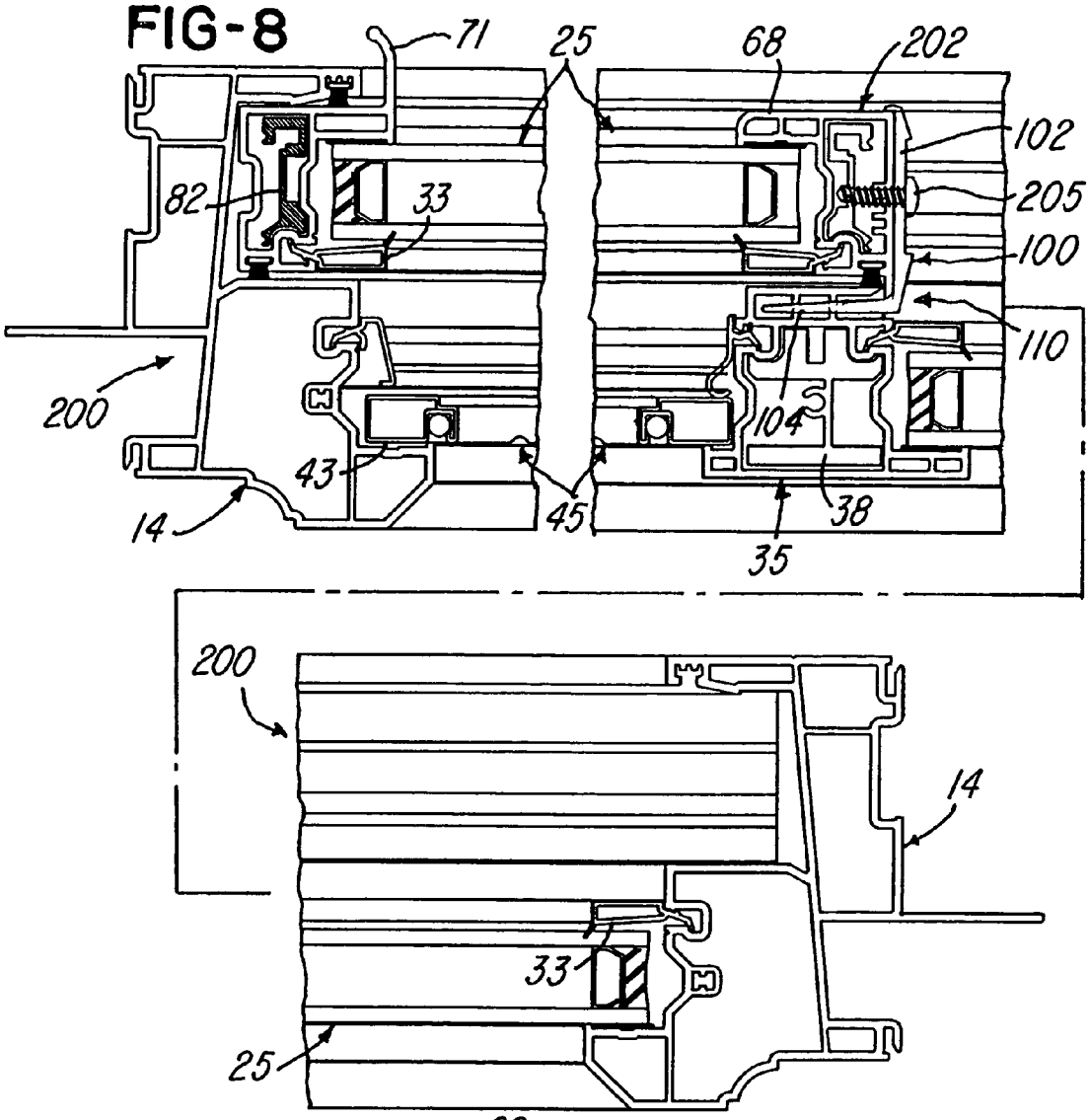
FIG. 8 is a horizontal section through a horizontal sliding window assembly incorporating an interlocking system in accordance with the invention and with portions broken away.
Figure 9:
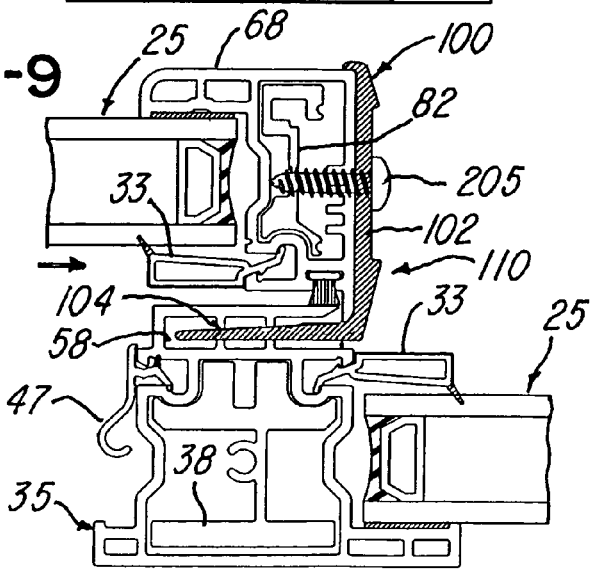
FIG. 9 is an enlarged fragmentary horizontal section of the center portion of the sliding window assembly shown in FIG. 8.

Referring to FIGS. 8 and 9, a double or single horizontal sliding window assembly may also be provided with an interlocking system 100 in accordance with the invention. Thus a single sliding window assembly 200 includes vertical main frame members 14 which receives a horizontal movable or sliding sash frame 202 having vertical sash frame members 68 and 71 constructed the same as disclosed above in connection with the single hung window assembly 10 and enclosing a glass panel unit 25. Thus the same reference numbers are used in FIGS. 8 and 9 for the same components of the window assembly 200. The sliding window assembly 200 also includes a fixed vertical sash frame member 35 which has the same profile as the horizontal sash frame member 35 described above in connection with FIGS. 2 and 3, and thus has the same reference numbers for common components.

As shown in FIG. 9, a clip member 100 extends vertically, and the flange portion 102 is secured directly to the vertical sash frame member 68 by a set of screws 205. The screws extend into the aluminum reinforcing member 82, and the flange portion 104 of the clip member 100 projects horizontally into the groove or slot 58 within the sash frame member 35. In all of the embodiments described in connection with FIGS. 3, 6 and 9, the flange portion 104 projects parallel to the glass panel units 25, and the flange portion 102 projects perpendicular to the glass panel units. Also, in the horizontal sliding window assembly 200, it is to be understood that an interlocking system 110 is located adjacent the upper horizontal main frame member, and another interlocking system 110 is located adjacent the lower horizontal main frame member. If desired, another interlocking system 110 may be located between the upper and lower interlocking systems.

From the drawings and the above description, it is apparent that a window assembly incorporating an interlocking system constructed in accordance with the invention provides desirable features and advantages. For example, interlocking system 110 may be used with various types of tilt latches 85 supplied from different manufacturers and may be selectively used on window assemblies likely to encounter substantial wind forces such as produced by a hurricane or a tornado. The interlocking system 110 may also be used on a single hung or double hung window assembly or on a single or double horizontal sliding window assembly, especially in those areas of the country that require the window assembly to pass the AAMA hurricane resistance tests. These tests are described in ASTM E1886 and ASTM 1986. The interlocking system 110 also provides the extra protection when a window assembly is subjected to large missile impact and after a glass unit 25 is broken. The interlocking system connects or locks the two adjacent overlapping sash members together so that the sash and window assemblies are solidly joined together as a unit when each movable window assembly is in its closed position.

While the insulation glass panel units 25 are illustrated with two glass panes or panels for simplification, it is to be understood that the units 25 may be constructed in other forms, for example, with three glass panels having two inner glass panels separated by a transparent inner layer of PVB. This construction or assembly is commonly used to prevent the glass panels from shattering into pieces and separating when subjected to a high wind force or impact causing the glass panels to crack.

While the forms of window assembly herein described constitute desirable embodiments of the invention, it is to be understood that the invention is not limited to these precise forms of assembly and that changes may be made therein without departing from the scope and spirit of the invention as defined in the appended claims. As mentioned above, the interlocking system of the invention may also be used with a sliding window assembly in the form of a sliding door with glass window units by providing the vertical adjacent and overlapping sash frame members with vertically spaced interlocking systems 110 as described above in connection with the horizontal sliding window assembly 200.

What is claimed is:

1. A window assembly comprising a main support frame including elongated plastic extrusions and adapted to be installed within an opening of a building structure, at least one movable sash frame surrounding a first glass window panel and supported for movement by said main support frame between an open position and a closed position, said movable sash frame including a first sash frame member, a second glass window panel supported by at least a second sash frame member positioned adjacent and horizontally overlapping said first sash frame member when said movable sash frame is in said closed position, a sash frame interlocking system including at least one clip member having a first flange extending perpendicular to said glass window panels and mounted on said first sash frame member, said clip member having a second flange connected to said first flange and extending parallel to said glass window panels, said second sash frame member including connected spaced apart walls defining a slot therebetween receiving said second flange of said clip member to interlock said first sash frame member to said second sash frame member in response to movement of said movable sash frame from said open position to said closed position, said spaced apart walls defining said slot being integrally connected by spaced apart tie walls having portions thereof cut away to define said slot, and said second flange being positioned to engage one of said spaced apart walls defining said slot therebetween in response to horizontal deflection of said sash frame members when said movable sash frame is in said closed position.

2. A window assembly as defined in claim 1 wherein said second flange and said one of said spaced apart walls defining said slot therebetween engage horizontally in response to either a below atmospheric air pressure or an above atmospheric air pressure on outer surfaces of said glass window panels and said sash frame members.

3. A window assembly as defined in claim 1 and including a tilt latch mounted on said first sash frame member of said movable sash frame, and said first flange of said clip member extends horizontally between said tilt latch and said first sash frame member.

4. A window assembly as defined in claim 3 wherein said clip member has an L-shaped cross-sectional configuration.

5. A window assembly as defined in claim 1 wherein said clip member comprises a section of a metal extrusion adjacent said main support frame, and said first flange has a flat top surface adapted to receive a tilt latch.

6. A window assembly as defined in claim 1 wherein said second sash frame member extends horizontally, said first flange of said clip member is mounted on a top surface of said first sash frame member, and said spaced apart walls defining said slot therebetween are integral with said second sash frame member.

7. A window assembly as defined in claim 6 and including a tilt latch mounted on said first flange of said clip member, and a set of threaded fasteners securing said tilt latch and said first flange of said clip member to said first sash frame member.

8. A window assembly as defined in claim 1 wherein said first sash frame member and said second sash frame member extend vertically.

9. A window assembly as defined in claim 1 wherein said first sash frame member defines a longitudinally extending internal chamber, a metal reinforcing extrusion extending within said chamber, and threaded fasteners securing said first flange of said clip member to said metal reinforcing extrusion.

10. A window assembly comprising a main support frame including elongated plastic extrusions and adapted to be installed within an opening of a building structure, at least one movable sash frame surrounding a first glass window panel and supported for movement by said main support frame between an open position and a closed position, said movable sash frame including a first sash frame member, a second glass window panel supported by at least a second sash frame member positioned adjacent and horizontally overlapping said first sash frame member when said movable sash frame is in said closed position, a sash frame interlocking system including at least one metal clip member having a first flange extending perpendicular to said glass window panels and mounted on said first sash frame member adjacent said main support frame, said clip member having a second flange integrally connected to said first flange and extending parallel to said glass window panels, said second sash frame member including integrally connected spaced apart walls defining a slot therebetween receiving said second flange of said clip member to interlock said first sash frame member to said second sash frame member in response to movement of said movable sash frame from said open position to said closed position, spaced apart tie walls integrally connecting said spaced apart walls defining said slot therebetween and having portions thereof cut away to define said slot, and said second flange being positioned to engage one of said spaced apart walls defining said slot therebetween in response to horizontal deflection of said sash frame members when said movable sash frame is in said closed position.

11. A window assembly as defined in claim 10 wherein said second flange and said one of said spaced apart walls defining said slot therebetween engage horizontally in response to either a below atmospheric air pressure or an above atmospheric air pressure on outer surfaces of said glass window panels and said sash frame members.

12. A window assembly as defined in claim 10 and including a tilt latch mounted on said first sash frame member of said movable sash frame, and said first flange of said clip member extends between said tilt latch and said first sash frame member.

13. A window assembly as defined in claim 10 and including a tilt latch mounted on said first flange of said clip member, and a set of threaded fasteners securing said tilt latch and said first flange of said clip member to said first sash frame member.

14. A window assembly as defined in claim 10 wherein said first sash frame member and said second sash frame member extend vertically.

15. A window assembly as defined in claim 10 wherein said first sash frame member defines a longitudinally extending internal chamber, a metal reinforcing member extending within said chamber, and threaded fasteners securing said first flange of said clip member to said metal reinforcing member.

* * * * *